US005403426A

United States Patent [19]

Johnson et al.

[11] Patent Number: 5,403,426

[45] Date of Patent: Apr. 4, 1995

[54] PROCESS OF MAKING CARDABLE HYDROPHOBIC POLYPROPYLENE FIBER

[75] Inventors: Roger W. Johnson, DeKalb, Ga.; Thomas W. Theyson, Mecklenburg, N.C.

[73] Assignee: Hercules Incorporated, Wilmington, Del.

[21] Appl. No.: 115,374

[22] Filed: Sep. 2, 1993

Related U.S. Application Data

[63] Continuation of Ser. No. 973,583, Nov. 6, 1992, abandoned, which is a continuation of Ser. No. 706,450, May 28, 1991, abandoned.

[51] Int. Cl.[6] ..... D01D 5/26; D01D 10/00; D01D 10/06; D01F 11/06

[52] U.S. Cl. ..... 156/256; 156/296; 156/308.8; 264/103; 264/129; 264/143; 264/168; 264/211.15; 264/211.16; 264/233; 427/386; 427/387; 427/393.1; 427/393.5

[58] Field of Search ..... 264/129, 211.13, 211.14, 264/211.15, 211.16, 233, 103, 143, 168; 427/384, 386, 387, 393.1, 393.5, 412.3; 156/256, 296, 305, 308.6, 308.8

[56] References Cited

U.S. PATENT DOCUMENTS

| | | | |
|---|---|---|---|
| 3,009,830 | 11/1961 | Levina | 428/394 |
| 3,377,181 | 4/1968 | Kajimo et al. | 19/46 |
| 3,433,008 | 3/1969 | Gage | 428/371 |
| 3,821,021 | 6/1974 | McMillin | 428/297 |
| 3,919,097 | 11/1975 | Park | 252/48.6 |
| 3,983,272 | 9/1976 | Huber et al. | 427/407.1 |
| 4,285,748 | 8/1981 | Booker | 156/167 |
| 4,624,793 | 11/1986 | Phifer et al. | 252/8.6 |
| 4,938,832 | 7/1990 | Schmalz | 156/308.8 |
| 4,995,884 | 2/1991 | Ross et al. | 8/115.6 |

FOREIGN PATENT DOCUMENTS

| | | |
|---|---|---|
| 0010764 | 5/1980 | European Pat. Off. . |
| 486158 | 5/1992 | European Pat. Off. . |
| 557024 | 8/1993 | European Pat. Off. . |
| 576896 | 1/1994 | European Pat. Off. . |
| 101987 | 6/1969 | Israel . |
| 828735 | 2/1960 | United Kingdom . |

OTHER PUBLICATIONS

U.S. Ser. No. 07/614,650, filed Nov. 15, 1990.
U.S. Ser. No. 07/835,895, filed Feb. 14, 1992.
U.S. Ser. No. 07/914,213, filed Jul. 15, 1992.
U.S. Ser. No. 08/016,346, filed Feb. 11, 1993.
U.S. Ser. No. 08/220,465, filed Mar. 30, 1994.
Abstract of JP 5-321,156 (Published Dec. 1993).
Abstract of JP 5-86,569 (Published Apr. 1993).

*Primary Examiner*—Leo B. Tentoni
*Attorney, Agent, or Firm*—Mark D. Kuller; Martin F. Sloan; John E. Crowe

[57] ABSTRACT

A method for preparing hydrophobic fiber for processing, inclusive of crimping, cutting, carding, compiling and bonding, without substantial loss in hydrophobic properties in the finished staple or corresponding nonwoven product through initial application of a surface modifier component comprising one or more of a class of water soluble compounds substantially free of lipophilic end groups and of low or limited surfactant properties.

60 Claims, No Drawings

PROCESS OF MAKING CARDABLE HYDROPHOBIC POLYPROPYLENE FIBER

This application is a continuation of application Ser. No. 07/973, filed Nov. 6, 1992, now abandoned, which is a continuation of application Ser. No. 07/706,450, filed May 28, 1991, now abandoned.

Fiber processing operations can be achieved without significant loss of desired hydrophobicity in processed polyolefin fiber or corresponding nonwoven products through early application of a special class of water soluble surface modifier agents having little or no surfactant properties.

BACKGROUND

While the production of polyolefin-based fiber, webs and corresponding nonwoven materials is well known in the textile art, attempts to broadly apply such general knowledge to produce products for personal hygiene purposes, such as catamenial devices, disposable diapers, incontinence pads and the-like, have met with serious technical problems due to significant differences in required fiber-spinning and working characteristics as opposed to properties desired in the final products.

In general, such products must have a fluid-absorbent core, usually comprising one or more layers of absorbent material such as wood pulp, rayon, gauze, tissue and the like and, in some cases, synthetic hydrophilic materials identified as super-absorbent powders such as a polyacrylate salt.

Such a fluid-absorbing core is most generally-shaped in the form of a pad of wood pulp, fiber and conjugate fiber, arranged in a rectangular or somewhat oval shape. To protect the wearer's clothing, and surrounding areas from stain or wetting by fluids already absorbed in such core, an externally positioned fluid-impervious barrier sheet is usually required. In addition, the absorbent device is separated from the body of the user by a one way water-permeable nonwoven cover sheet or facing contacting the body.

A particularly troublesome technical problem arises where a high degree of hydrophobicity is desired in a nonwoven coversheet component consisting substantially of conventionally bonded webs of hydrophobic fiber such as polyolefin-containing staple fiber.

In general, untreated hydrophobic fiber of such type quickly becomes unworkable due to friction and accumulated static charges during conventional spinning, crimping, cutting and carding operations. For this reason, the prior art has lone-recognized and used a variety of topically applied lubricant and antistatic agents which impart hydrophilic properties to an extent sufficient to permit conventional fiber processing. In commercial use, however, such treatment frequently results in a final fiber or nonwoven product which is substantially more hydrophilic than desired.

In particular, because of the nature of commercial high speed operations, and the somewhat unpredictable affinity of known lubricating and antistatic agents to individual fiber batches of the hydrophobic-type, it is very difficult to maintain adequate control over the wetting characteristics of the final nonwoven product.

It is an object of the present invention to prepare hydrophobic polyolefin-containing spun fiber or filament for conventional fiber processing, inclusive of crimping, cutting, carding and bonding steps, without sacrificing hydrophobic characteristics of the commercial product.

THE INVENTION

The above objects are obtained in accordance with the present invention by preparing extruded polyolefin-containing fiber or filament for forming a nonwoven material of high hydrophobicity comprising (a) $R^{\nu}$ is defined as an amine salt or an alkali metal salt; initially contacting a corresponding extruded continuous spun fiber or filament with an active amount of a water soluble surface modifier component, having low or limited surfactant properties, and comprising 2 at least one compound within the class defined by the formulae $$(R)_m-C-(CH_2OR)_{4-m} \quad (1)$$

$$\begin{array}{c} CH_2-OR_1 \\ | \\ (CH-OR_1)_n \\ | \\ CH_2-OR_1 \end{array} \quad (2)$$

$$R_2-(OCH_2CH_2)_o-OR_3 \quad (3)$$

$$R_2-[(OCH_2CH_2)_p(OCH_2\overset{\overset{CH_3}{|}}{C}H)_q]-OR_4 \quad (4)$$

in which

R is individually defined as hydrogen or a 1–4 carbon alkyl group, inclusive of $CH_3$— and $C_4H_9$—;

$R_1$, $R_2$, $R_3$, and $R_4$ are individually defined as members selected from a straight or branched lower molecular weight acyl, alkyl, or a hydrogen group, inclusive of $CH_3CO$— to $CH_3(CH_2)_4CO$—, $CH_3$—O— to $CH_3(CH_2)_5$—O—, and H— substituents;

m is defined as an integer of about 0–3;

n is defined as an integer of about 0–4;

o is defined as an integer of about 2–50;

p is defined as an integer of about 2–50; and q is defined as an integer of about 1–10;

wherein p/q is not less than about 4.

(b) processing the resulting surface modifier-treated spun fiber or filament, comprising one or more of crimping and an optional water-washing step, to at least partly remove the applied surface modifier component, at a point downstream of the fiber crimping step.

As desired, the fiber or filament is processed as continuous fiber to form a web, or alternatively cut, and the resulting staple carded and formed into one or more webs, which are then compiled in machine or other direction, and conventionally bonded using a calendar pressure, sonic, laser and the like bonding technique, to form the desired hydrophobic nonwoven material.

For present purposes the above (a) contacting step is conveniently carried out by conventionally dipping, spraying or wheel printing one or more compound falling within the above-defined class of surface modifier components; for such purpose they may be applied as is or in the form of an aqueous solution (1–99% by weight) or even as a water-in-oil emulsion applied onto a corresponding continuous spun filament or fiber and dried. Of particular interest for such purpose is roller application of the corresponding aqueous solution applied immediately downstream of a gas or other quenching step.

Surface modifiers within the scope of the present invention, and as described in formulae 1–4 supra, are characterized as essentially water soluble compounds which are lacking in, or short of lipophilic chemical moieties, and which possess low or limited surfactant properties when applied onto a hydrophobic fiber surface.

Such modifier compounds are examplified, for instance (1) As water-soluble esters or polyesters generally obtained by reacting a polyol such as glycerol, ethylene glycol, propylene glycol, neopentyl glycol, glycerine, trimethylolethane, trimethylolpropane, pentaerythritol or sorbitol with a short linear or branched chain (i.e. up to about 6 carbon) fatty acid to obtain compounds a modifier such as glycerol triacetate, pentaerythritoltetracetate, propyleneglycol dipropionate, trimethylolpropane dibutanoate and the like;

(2) As glycols or capped (i.e. up to 6 carbon fatty acid) glycols obtained by reacting polyols such as above-listed with ethylene oxide or a combination of ethylene oxide with a limited amount (i.e. up to about 20%) of propylene oxide to obtain a blocked or random-type polyoxyalkylene polyol. Specific examples of such products include Polyoxyethylene glycol (POE glycol) 400, POE glycol 2000, POE (10) glycerine, POE (20) sorbitol, butyl-capped EO/PO polymer (90/10 ratio with average molecular weight=1000), polyethylene glycol (PEG) 600 diacetate, and POE (10) sorbitol dipropionate (3) as alkoxylated products such as polyoxyethylene (POE) or polyoxypropylene (POP) derivatives based on hetero atoms such as nitrogen, phosphorus, silicon, or corresponding heterocyclic molecules. Examples include, for instance, a 9/10 ratio of EO/PO polymer based on ethylenediamine (1500 mw), polyoxyethylene (10) methylamine, polyoxyethylene (20) dimethylhydantoin, polyoxyethylene (10) dimethylsilicate, polyoxyethylene (2) butyl phosphate, triethanolamine triacetate, and the like; and (4) as products of the above-three classes conventionally converted to a highly polar or ionic structure which could also function as lubricants. Specific examples of such type of product include: POE (12) dimethylamine oxide, POE (10) methyl ethyl ammonium methylsulfate, a carboxyl ethyl betaine-based on triethanolamine, and the potassium salt of a mono-diphosphate prepared from methyl capped PEG (350).

For present purposes, the term "an active amount," usefully includes about 0.02%–0.8% and preferably about 0.1%–0.5% of the water-soluble surface modifier component, based on total fiber weight, for purposes of carrying out the "(a)" initial fiber-contacting step, while the subsequent "(b)" processing step is here defined as the step of passing through a series of stations, comprising crimping, overfinishing (optional), water washing (optional), cutting (normally $\frac{3}{4}''$–$1\frac{1}{2}''$), carding to form fiber webs, compiling the webs, and bonding the compiled webs.

For purposes of the present invention, the above defined "(b)" processing step can optionally include the application of about 0.05%–0.80%, and preferably 0.1%–0.5% by weight of fiber, of a fiber overfinish composition at or downstream of a fiber crimping station, an overfinish comprising (A) about 0%–65%, by composition weight, of at least one polysiloxane represented by the formula

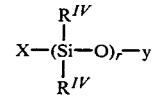

(4)

wherein X and y are individually defined as a hydrophobic chemical end group such as a lower alkyl group;

$R^{IV}$ is individually defined as a lower alkyl such as a methyl or octyl group; and r is defined as a positive number within the range of about 10–50 or higher; and (B) about 35%–100%, by weight of composition, of at least one neutralized phosphoric acid ester represented by the formula

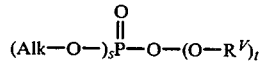

(5)

wherein

Alk is individually defined as a lower alkyl group, inclusive of a 1–8 carbon alkyl such as methyl or octyl;

$R^{V}$ is defined as an amine salt or an alkali metal salt; and s and t are individually defined as positive numbers of not less than about 1, the sum of which is about 3.

For present purposes the term "polyolefin-containing fiber or filament" is defined as including continuous as well as staple melt spun fiber which are obtainable from conventionally blended isotactic polypropylene and/or art-recognized hydrophobic copolymers thereof with ethylene, 1-butene, 4-methylpentene-1 and the like. The resulting spun melt preferably has a weight average varying from about $3\times10^5$ to about $5\times10^5$, a molecular weight distribution of about 5.0–8.0, a spun melt flow rate of about 13.0 to about 40 g/10 minutes, and a spin temperature conveniently within a range of about 220° C.–315° C.

Also includable within suitable polyolefin-containing spun melt employed in carrying out the present invention are various art-recognized fiber additives, including pH stabilizers such as calcium stearate, antioxidants, pigments, such as whitenets and colorants such as $TiO_2$ and the like. Generally such additives can vary, in amount, from about 0.5%–3% collectively by weight of spun melt.

The present invention is found particularly applicable to high speed production of a variety of nonwoven materials utilizing webs obtained, for instance, from spun bonded and/or carded staple, and may also comprise additional web components such as fibrillated film of the same or different polymer. In each case, the fiber- or filament-handling difficulties caused by friction and accumulated static charge can be controlled without unacceptable sacrifice in strength or hydrophobic properties in the final nonwoven product by use of the above-defined water-soluble surface modifier component.

Continuous spun fiber or filaments used to form webs within the scope of the present invention preferably comprise topically treated spun melt staple fiber, filament or fibrillated film of bicomponent or monofilament types, the above-defined surface modifier and finishing compositions being conventionally applied by drawing over a feed wheel partially immersed in a bath of the modifier composition, dipped therein, or sprayed in effective amount for fiber processing, and dried.

For present purposes, webs used to form nonvovens within the scope of the present invention can be formed by spunbonded, melt blown or conventional carded processes using staple fiber and bonded together using techniques employing adhesive binders (U.S. Pat. No. 4,535,013), calender rolls, hot air, sonic, laser, pressure bonding, needle punching and the like, known to the art.

Webs used to fabricate nonwoven material can also usefully comprise conventional sheath/core or side-by-side bicomponent fiber or filament, alone or combined with treated or untreated homogenous-type fiber or filament and/or fibrillated film.

Also within the scope of the present invention is the use of nonwovens comprised of one or more bonded webs of modifier-treated polyolefin fiber- and/or fiber-like (fibrillated film) components having a mixed fiber denier of homogeneous and/or bicomponent types not exceeding about 40 dpf. Such webs preferably utilize fiber or filaments within a range of about 0.1–40 dpf.

In addition, the resulting nonwoven material can be embossed and/or calender printed conventionally with various designs and colors, as desired, to increase loft, augment wet strength, and provide easy market identification.

In addition, webs used in forming nonwovens within the scope of the present invention are produced from one or more types of conventionally spun fibers or filaments having, for instance, round, delta, trilobal, or diamond cross sectional configurations.

Nonwoven cover stock of the above-defined types can usefully vary in weight from about 10–45 gm $yd^2$ or higher.

The invention is further illustrated but not limited by the following Examples and Tables:

EXAMPLE 1

Polypropylene fiber samples S-1, S-2 and S-3 are individually prepared from a polypropylene resin batch in flake form having a molecular weight distribution of about 5.0 and a melt flow rate of about 13.0 g/10 minutes.

Each resin sample is then admixed with 0.05% by weight of calcium stearate as a conventional pH stabilizer and 0.01% by weight of titanium dioxide as pigment for sixty (60) minutes in a tumbling blender. The blended flake is then extruded through a 675 circular hole spinnerette at 300 C and the resulting extruded filaments are air quenched (ambient) and a modifier finish ("A" or "B") of indicated ratios (*3) of glycerine and morpholine-neutralized phosphoric acid ester (*1) are topically applied to the respective filaments by roll applicator, to impart about 0.3%–0.5% by dry fiber weight of the initial finish (i.e. "A" "B" "C" finish).

The resulting coated filaments are then drawn to about 2.0–2.4 dpf (grams/9000 meters) and crimped in a conventional steam crimper (100° C.), with simultaneous application of the "D" or "E" optional over finish (*3), consisting of indicated ratios of morpholine-neutralized phosphoric acid ester/poly(dimethylsiloxane) (*2) applied through steam injection holes in the crimper stuffer box. Control sample S-3 utilizes Lurol PP-912*1 as a standard hydrophilic spin finish.

(*1) Lurol® AS-Y and PP-912 obtained commercially from G. A. Goulston Co. of Monroe, N.C.
(*2) LE-458HS-obtained commercially from Union Carbide Corporation.
(*3) Finish A is a 25%/75% ratio of morpholine neutralized phosphoric acid ester and glycerine
Finish B is a 17%/83% ratio of morpholine neutralized phosphoric acid ester and glycerine
Finish C is a commonly used hydrophilic finish for polypropylene identified as Lurol PP 912
Finish D is a morpholine neutralized phosphoric acid ester alone.
Finish E is a 50%/50% ratio of morpholine neutralized phosphoric acid ester and polydimethylsiloxane.

The treated filaments are then dried, cut into 1.5 inch staple, and set aside for conventional absorbency and hydrophobicity testing.

(A) The absorbency test employed is based on modified ASTM test Method D-1117-79, in which five (5) grams of the dry treated staple fiber is loosely packed into a 50 CC wire basket, weighed and then placed into a tank of water. After 30 seconds, the basket is removed, drained for 30 seconds and then weighed to measure the amount of water absorbed and % absorbency calculated on a weight basis. Hydrophobic fibers typically pick up 20%-600% because of random pore size and droplets adhering to the basket surface.

(B) The relative hydrophobicity of the treated fiber is conventionally ascertained, when necessary, by observed fiber contact angle (i.e. % with contact angle 90; Wilhelmy "The Physical Chemistry of Surfaces" 3rd Ed., Wiley & Sons 1976 pg. 344.)

EXAMPLE 2

Polypropylene fiber sample S-4, S-5 and S-6 are prepared by tumbling the same batch resin plus identical stabilizer and pigment in the same amount and manner as Example 1, the blended flake then being extruded at 295 C. through a 782 circular hole spinnerette and air quenched (ambient). The resulting filaments are then topically treated by roll applicator with a 1% aqueous solution of potassium-neutralized phosphoric acid ester (*4) (*1) as a spin finish to obtain about 0.16% initial filament finish based on dry fiber weight.

The resulting filaments are then drawn, as before, to about 2.0–2.4 dpf, steam crimped, and a surface modifier finish applied through steam injection holes in the crimper stuffer box to obtain a final finish of about 0.20%–0.50% by weight, the fiber then being dried, cut into 1.5 inch length staple, and set aside for testing. Test results are reported in Table 2 below:

TABLE I

| Sample # | Modifier Modifier Finish (*3) | Level | Optional Overfinish (*3) | Total Finish | Total Absorbency | Degree of (*4) Hydrophobicity |
|---|---|---|---|---|---|---|
| S-1 | A. | 0.33% | D. | 0.39% | 59% | 5 |
| S-2 | B. | 0.49% | E. | 1.70% | 575% | 4 |

TABLE I-continued

| Sample # | Modifier Modifier Finish (*3) | Level | Optional Overfinish (*3) | Total Finish | Total Absorbency | Degree of (*4) Hydrophobicity |
|---|---|---|---|---|---|---|
| S-3 (control) | C. | 0.30% | C. | 0.90% | 138.2% | 1 |

(*3)
Finish A is a 25%/75% ratio of morpholine neutralized phosphoric acid ester and glycerine
Finish B is a 17%/83% ratio of morpholine neutralized phosphoric acid ester and glycerine
Finish C is a commonly used hydrophilic finish for polypropylene identified as Lutol PP 912.
Finish D is a morpholine neutralized phosphoric acid ester alone.
Finish E is a 50%/50% ratio of morpholine neutralized phosphoric acid ester and polydimethylsiloxane.
Finish F is Potassium-neutralized phosphoric acid ester.
(*4) "1" indicates fully hydrophilic and "5" indicates fully hydrophobic.

TABLE II

| Degree of Sample # | Spin Finish (*3) | Level | Modifier (*5)(*2) Overfinish | Finish | Total Absorbency | Degree of (*4) Hydrophobicity |
|---|---|---|---|---|---|---|
| S-4 | F. | 0.16% | G. | 0.21% | 44.7% | 5 |
| S-5 | F. | 0.16% | H. | 0.26% | 109.6% | 5 |
| S-6 | F. | 0.16% | I. | 0.49% | 87.5% | 5 |

(*6)
Finish G is a 50%/50% ratio of potassium-neutralized phosphoric acid ester and polydimethylsiloxane.
Finish H is a 50%/50% ratio of potassium-neutralized phosphoric acid ester and polyoxyethylene glycol (400).
Finish I is 17%/83% ratio of potassium-neutralized phosphoric acid ester and polyoxyethylene glycol (400).

What we claim and desire to protect by Letters Patent is:

1. A method of preparing extruded polyolefin-containing fiber or filament suitable for processing to form a nonwoven material of high hydrophobicity, comprising:

(a) extruding polyolefin resin to form a polyolefin containing fiber or filament; and (b) applying to the polyolefin-containing fiber or filament an active amount of at least one water-soluble surface modifier compound having low or limited surfactant properties selected from the group consisting of compounds of formulae (1) to (4):

$$R_m-C-(CH_2OR)_{4-m} \quad (1)$$

$$\begin{array}{c} CH_2-OR_1 \\ | \\ (CH-OR_1)_n \\ | \\ CH_2-OR_1 \end{array} \quad (2)$$

$$R_2-(OCH_2CH_2)_o-OR_3 \quad (3)$$

and $$R_2-[(OCH_2CH_2)_p-(OCH_2\overset{\overset{CH_3}{|}}{C}H)_q]-OR_4 \quad (4)$$

wherein

R is individually a member selected from the group consisting of hydrogen and a 1–4 carbon alkyl group $R_1$, $R_2$, $R_3$, and $R_4$ are individually members selected from the group consisting of acyl, alkyl and hydrogen;

m is defined as 0 to about 3;

n is defined as 0 to about 4;

o and p are individually an integer of about 2–50; and q is an integer of about 1–10;

wherein the ratio of p/q is not less than about 4; and optionally, (c) cutting the filament to form a staple fiber; wherein the resulting fiber or filament is hydrophobic.

2. The method of claim 1 wherein the water soluble surface modifier compound comprises at least one compound selected from the group consisting of polyoxyethylene glycol of up to about 2000 wt. av./molecular weight, polyoxyethylene (10) glycerine, polyoxyethylene (20) sorbitol, capped ethylene oxide (9)/propylene oxide (1) up to about 2000 weight average molecular weight, polyethylene glycol (600) diacetate, and polyoxyethylene(10) sorbitol dipropionate.

3. The method of claim 1, further comprising processing the resulting modified fiber or filament by water-washing said fiber or filament to at least partially remove said surface modifier compound 4. The method of claim 1 wherein the surface modifier component comprises a compound of the formula (1).

5. The method of claim 1 wherein the surface modifier component comprises a compound of the formula (2).

6. The method of claim 1 wherein the surface modifier component comprises a compound of the formula (3).

7. The method of claim 1 wherein the surface modifier component comprises a compound of the formula (4).

8. The method of claim 1 wherein 0.02 to 0.8 %, by weight of the fiber or filament, of the at least one water-soluble surface modifier is applied during step (b).

9. The method of claim 1 wherein 0.1 to 0.5%, by weight of the fiber or filament, of the at least one water-soluble surface modifier is applied during step (b).

10. The method of claim 1 wherein the water-soluble surface modifier compound is selected from the group consisting of water-soluble esters or polyesters obtained by reacting a polyol selected from the group consisting of glycerol, ethylene glycol, propylene glycol, neopentyl glycol, glycerine, trimethylolethane, trimethylolpropane, pentaerythritol and sorbitol with a compound selected from the group consisting of linear or branched chain fatty acids having up to 6 carbon atoms.

11. The method of claim 1 wherein the water-soluble surface modifier compound is selected from the group consisting of glycols and capped glycols obtained by reacting a polyol selected from the group consisting of glycerol, ethylene glycol, propylene glycol, neopentyl glycol, glycerine, trimethylolethane, trimethylolpropane, pentaerythritol and sorbitol with ethylene oxide containing up to 20% of propylene oxide.

12. The method of claim 8 wherein $R_1$, $R_2$, $R_3$, and $R_4$ are individually selected from the group consisting of $C_2$–$C_6$ acyl, $C_1$–$C_6$ alkyl and hydrogen.

13. The method of claim 1 further comprising following the applying step a steam crimping step, and application at or downstream of the crimping step of an overfinish composition comprising:

(A) about 0%–65% by weight of the overfinish composition of at least one polysiloxane represented by the formula

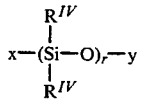

wherein x and y are individually hydrophobic chemical end groups; $R^{IV}$ is individually a lower alkyl group; and r is a positive number within the range of about 10–50; and (B) about 35%–100% by weight of the overfinish composition of at least one neutralized phosphoric acid ester represented by the formula

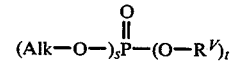

wherein Alk is individually a lower alkyl group; $R^V$ is an amine salt or an alkali metal salt; and s and t are individually positive numbers of not less than 1, the sum of which is about 3.

14. The method of claim 13 wherein the overfinish composition is applied to the fiber or filament and thereafter the fiber or filament is cut.

15. The method of claim 1 wherein the applying comprises applying a mixture of the at least one water-soluble surface modifier and a neutralized phosphoric acid ester.

16. The method of claim 15 wherein the neutralized phosphoric acid ester is represented by the formula

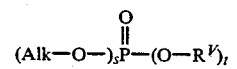

wherein Alk is individually a lower alkyl group; $R^V$ is an amine salt or an alkali metal salt; and s and t are individually positive numbers of not less than 1, the sum of which is about 3.

17. A method of preparing extruded polyolefin-containing fiber or filament suitable for processing to form a nonwoven material of high hydrophobicity, comprising:

(a) extruding a polyolefin resin to form a polyolefin containing filament;

(b) applying to the polyolefin-containing filament an active amount of at least one water-soluble surface modifier compound having low or limited surfactant properties which comprises at least one alkoxylated derivative of a polyoxyethylene or polyoxypropylene compound containing heteroatoms selected from the group consisting of nitrogen, silicon and phosphorus; and optionally, (c) cutting the filament to form a staple fiber;

wherein the resulting fiber or filament is hydrophobic.

18. The method of claim 17 wherein the water-soluble surface modifier compound is selected from the group consisting of 9/10 ratio of ethylene oxide/propylene oxide polymer based on ethylenediamine (1500), polyoxy-ethylene (10) methylamine, polyoxyethylene (20) dimethyl-hydantoin, polyoxyethylene (10) dimethylsilicate, polyoxyethylene (2) butyl phosphate and triethanolamine triacetate.

19. The method of claim 17 wherein the applying comprises applying an aqueous solution comprising the water-soluble surface modifying compound.

20. The method of claim 19 wherein the applying comprises applying an aqueous solution comprising the water-soluble surface modifying compound.

21. A method comprising:

(a) providing a polyolefin filament; and (b) applying to the polyolefin fiber or filament an aqueous solution comprising at least One water-soluble surface modifier compound selected from the group consisting of:

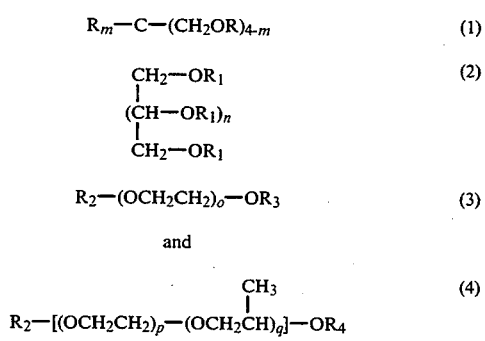

wherein R is individually selected from the group consisting of hydrogen and a 1 to 4 carbon alkyl group; $R_1$, $R_2$, $R_3$, and $R_4$ are individually selected from the group consisting of acyl, alkyl and hydrogen; m is 0 to about 3; n is 0 to about 4; o and p are about 2 to 50; and q is about 1 to 10; and the ratio of p/q is not less than about 4; and optionally, cutting the filament to form a staple fiber; wherein the resulting fiber or filament is hydrophobic.

22. A method as claimed in claim 21 comprising sequentially extruding to form the polyolefin filament, crimping the filament, and cutting the filament to form a staple fiber.

23. A method as claimed in claim 22, further comprising carding and bonding the staple fibers so as to form a hydrophobic nonwoven material, wherein the resulting nonwoven material is hydrophobic.

24. A method as claimed in claim 21 wherein the polyolefin containing fiber or filament is a polypropylene fiber or filament.

25. A method as claimed in claim 24 wherein the polypropylene is selected from the group consisting of isotactic polypropylene and copolymers of propylene and ethylene, 1-butene, and 4-methylpentene-1.

26. The method of claim 21 wherein the aqueous solution is topically applied to the filament by drawing over a wheel partially immersed in the aqueous composition, dipping the filament in the aqueous composition or spraying the aqueous composition onto the filament.

27. The method of claim 21 wherein the aqueous solution is topically applied to the filament by drawing over a wheel partially immersed in the aqueous composition.

28. The method of claim 21 wherein the water-soluble surface modifier compound is a compound selected from the group consisting of glycerine, glycerol triacetate, pentaerythritol tetraacetate, propylene glycol dipropionate and trimethylolpropane dibutanoate.

29. The method of claim 21 wherein the water-soluble surface modifier compound is a compound selected from the group consisting of polyoxyethylene glycol, polyoxyethylene glycerine, polyoxyethylene sorbitol, capped ethylene oxide/propylene oxide, polyethylene glycol diacetate, and polyoxyethylene sorbitol dipropionate.

30. The method of claim 23 wherein the method comprises sequentially extruding to form the filament; the applying the aqueous solution; the crimping and application at or downstream of the crimping step an overfinish composition comprising:

(A) about 0%–65% by weight of the overfinish composition of at least one polysiloxane represented by the formula

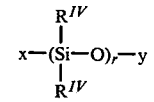

wherein x and y are individually hydrophobic chemical end groups; $R^{IV}$ is a lower alkyl group; and r is a positive number within the range of about 10–50; and (B) about 35%–100%, by weight of the overfinish composition, of at least one neutralized phosphoric acid ester represented by the formula

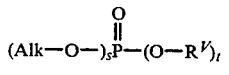

wherein Alk is individually a lower alkyl group; $R^{V}$ is individually an amine salt or an alkali metal salt; and s and t are individually positive numbers of not less than 1, the sum of which is about 3.

31. The method of claim 30 wherein the overfinish composition is applied to the fiber or filament and thereafter the filament is cut to form a staple fiber.

32. The method of claim 22, further comprising water-washing said filament to at least partially remove the surface modifier compound after the crimping.

33. The method of claim 22 wherein the aqueous solution is applied topically to the extruded fiber or filament immediately downstream of a filament quenching operation.

34. The method of claim 21 wherein the water-soluble surface modifier compound is a compound of the formula (1).

35. The method of claim 21 wherein the water-soluble surface modifier compound is a compound of the formula (2).

36. The method of claim 21 wherein the water-soluble surface modifier compound is a compound of the formula (3).

37. The method of claim 21 wherein the water-soluble surface modifier compound is a compound of the formula (4).

38. A method as claimed in claim 21 comprising sequentially extruding to form the polyolefin filament; the applying to the polyolefin fiber or filament an aqueous solution wherein the applying comprises applying 0.02 to 0.8 %, by weight of the fiber or filament, of the at least one water-soluble surface modifier; steam crimping the filament; and cutting the filament to form a staple fiber.

39. The method of claim 38 wherein the applying comprises applying 0.1 to 0.5% of the at least one water-soluble surface modifier.

40. The method of claim 22 wherein the applying is carried out after the crimping.

41. A method comprising:

(a) providing a polyolefin containing filament; and (b) applying to the polyolefin containing fiber or filament a solution comprising at least one water-soluble surface modifier compound selected from the group consisting of:

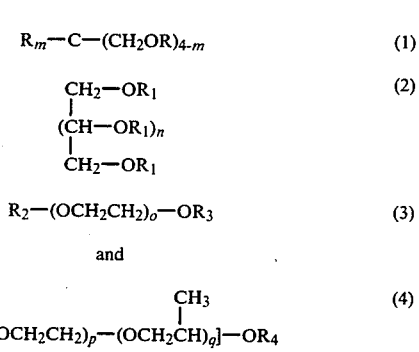

wherein R is individually selected from the group consisting of hydrogen and a 1 to 4 carbon alkyl group; $R_1$, $R_2$, $R_3$, and $R_4$ are individually selected from the group consisting of $C_2$–$C_6$ acyl, $C_1$–$C_6$ alkyl and hydrogen; m is 0 to about 3; n is 0 to about 4;

o and p are about 2 to 50; and q is about 1 to 10; and the ratio of p/q is not less than about 4; and optionally, cutting the filament for form a staple fibers wherein the resulting fiber or filament is hydrophobic.

42. A method as claimed in claim 41 comprising sequentially extruding to form the polyolefin containing filament, steam crimping the filament, and cutting the filament to form a staple fiber.

43. A method as claimed in claim 42 further comprising carding and bonding the staple fibers so as to form a hydrophobic nonwoven material, wherein the resulting nonwoven material is hydrophobic.

44. A method as claimed in claim 41 wherein the polyolefin containing fiber or filament is a polypropylene fiber or filament.

45. A method as claimed in claim 44 wherein the polypropylene is selected from the group consisting of isotactic polypropylene and-copolymers of propylene and ethylene, 1-butene, and 4-methylpentene-1.

46. The method of claim 41 wherein the aqueous solution is topically applied to the filament by drawing over a wheel partially immersed in the aqueous composition, dipping the filament in the aqueous composition or spraying the aqueous composition onto the filament.

47. The method of claim 41 wherein the aqueous solution is topically applied to the filament by drawing over a wheel partially immersed in the aqueous composition.

48. The method of claim 41 wherein the water-soluble surface modifier compound is a compound selected from the group consisting of glycerine, glycerol triacetate, pentaerythritol tetraacetate, propylene glycol dipropionate and trimethylolpropane dibutanoate.

49. The method of claim 41 wherein the water-soluble surface modifier compound is a compound selected from the group consisting of polyoxyethylene glycol, polyoxyethylene glycerine, polyoxyethylene sorbitol, capped ethylene oxide/propylene oxide, polyethylene glycol diacetate, and polyoxyethylene sorbitol dipropionate.

50. The method of claim 42 wherein the method comprises sequentially extruding to form the filament; the applying the aqueous solution; the crimping and application at or downstream of the crimping step an overfinish composition comprising:

(A) about 0%-65% by weight of the overfinish composition of at least one polysiloxane represented by the formula

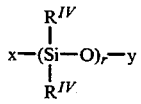

wherein x and y are individually hydrophobic chemical end groups; $R^{IV}$ is a lower alkyl group; and r is a positive number within the range of about 10-50; and (B) about 35%-100%, by weight of the overfinish composition, of at least one a neutralized phosphoric acid ester represented by the formula

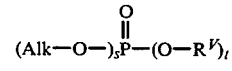

wherein Alk is individually a lower alkyl group; $R^{V}$ is an individually amine salt or an alkali metal salt; and s and t are individually positive numbers of not less than 1, the sum of which is about 3.

51. The method of claim 50 wherein the overfinish composition is applied to the fiber or filament and thereafter the filament is cut to form a staple fiber.

52. The method of claim 42, further comprising water-washing said filament to at least partially remove said surface modifier component after the crimping.

53. The method of claim 42 wherein the aqueous solution is applied topically to the extruded fiber or filament immediately downstream of a filament quenching operation.

54. The method of claim 41 wherein the water-soluble surface modifier compound is a compound of the formula (1).

55. The method of claim 41 wherein the water-soluble surface modifier compound is a compound of the formula (2).

56. The method of claim 41 wherein the water-soluble surface modifier compound is a compound of the formula (3).

57. The method of claim 41 wherein the water-soluble surface modifier compound is a compound of the formula (4).

58. A method as claimed in claim 41 comprising sequentially extruding to form the polyolefin filament; the applying to the polyolefin fiber or filament an aqueous solution wherein the applying comprises applying 0.02 to 0.8%, by weight of the fiber or filament, of the at least one water-soluble surface modifier; crimping the filament; and cutting the filament to form a staple fiber.

59. The method of claim 58 wherein the applying comprises applying 0.1 to 0.5% of the at least one water-soluble surface modifier.

60. A method of preparing extruded polyolefin containing fiber or filament for processing to form a nonwoven material of high hydrophobicity, comprising:

(a) extruding polyolefin resin to form a polyolefin containing fiber or filaments and (b) applying to the polyolefin-containing fiber or filament an active amount of at least one water-soluble surface modifier compound having low or limited surfactant properties selected from the group consisting of polyoxyethylene (12) dimethylamine oxide, polyoxyethylene (10) methyl ethyl ammonium methylsulfate, carboxyl ethyl betaine based on triethanolamine, and the potassium salt of mono-diphosphate prepared from methyl capped polyethylene glycol (350).

* * * * *